US005543035A

United States Patent [19]

Ziemer

[11] Patent Number: 5,543,035

[45] Date of Patent: Aug. 6, 1996

[54] PROCESS FOR PRODUCING A HIGH QUALITY LUBRICATING OIL USING A VI SELECTIVE CATALYST

[75] Inventor: James N. Ziemer, Hercules, Calif.

[73] Assignee: Chevron U.S.A. Inc., San Francisco, Calif.

[21] Appl. No.: 284,933

[22] Filed: Aug. 1, 1994

[51] Int. Cl.[6] ..... C10G 47/20

[52] U.S. Cl. ..... 208/111; 208/112; 208/58

[58] Field of Search ..... 208/108, 109, 208/110, 111, 112, 58, 59, 96, 97

[56] References Cited

U.S. PATENT DOCUMENTS

| | | | |
|---|---|---|---|
| 3,536,605 | 10/1970 | Kittrell | 208/59 |
| 3,730,876 | 5/1973 | Sequeira, Jr. | 208/59 |
| 3,835,027 | 9/1974 | Ward | 208/111 |
| 4,066,574 | 1/1978 | Tamm | 252/439 |
| 4,113,661 | 9/1978 | Tamm | 252/465 |
| 4,162,962 | 7/1979 | Stangeland | 208/58 |
| 4,341,625 | 7/1982 | Tamm | 208/216 |
| 4,347,121 | 8/1982 | Mayer et al. | 208/58 |
| 4,695,365 | 9/1987 | Ackelson et al. | 208/89 |
| 4,699,707 | 10/1987 | Moorehead et al. | 208/57 |
| 4,976,848 | 12/1990 | Johnson | 208/251 |
| 5,089,463 | 2/1992 | Johnson | 502/313 |
| 5,171,422 | 12/1992 | Kirker et al. | 208/111 |
| 5,177,047 | 1/1993 | Threlkel | 502/200 |
| 5,215,955 | 6/1993 | Threlkel | 502/221 |
| 5,308,472 | 5/1994 | Dai et al. | 208/111 |
| 5,342,507 | 8/1994 | Dai et al. | 208/111 |
| 5,393,408 | 2/1995 | Ziemer et al. | 208/57 |
| 5,393,409 | 2/1995 | Jan et al. | 208/108 |
| 5,397,456 | 3/1995 | Dai et al. | 208/108 |

*Primary Examiner*—Asok Pal
*Assistant Examiner*—Bekir L. Yildirim
*Attorney, Agent, or Firm*—A. W. Klaassen

[57] ABSTRACT

A process is provided for producing a high quality lubricating oil base stock with a catalyst having a high viscosity index selectivity and low fouling rate. The catalyst contains a low amount of zeolite, and has a pore size distribution characterized by a significant amount of large pores.

19 Claims, 1 Drawing Sheet

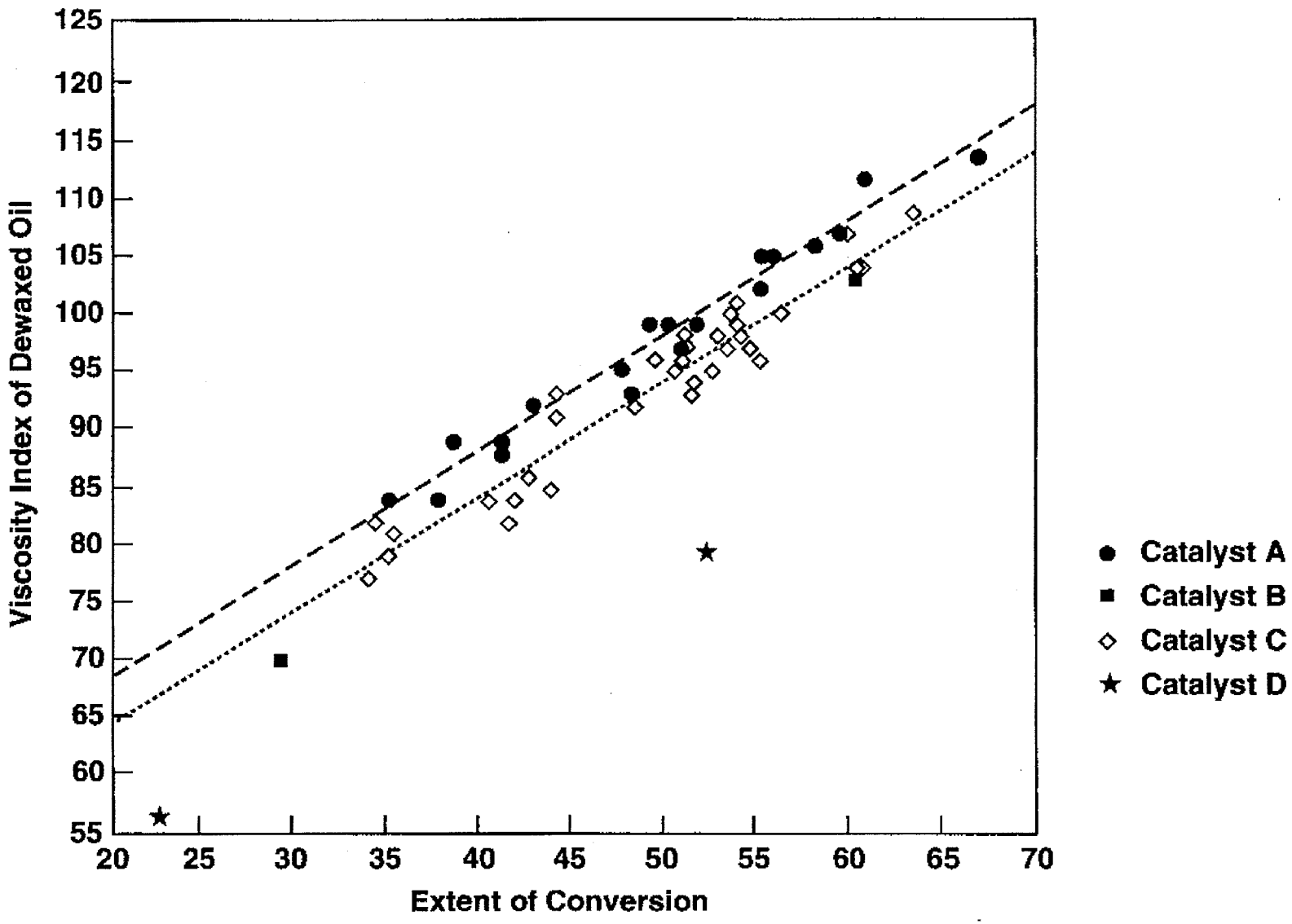
Catalyst A
Catalyst B
Catalyst C
Catalyst D
Viscosity Index of Dewaxed Oil
125
120
115
110
105
100
95
90
85
80
75
70
65
60
55
20
25
30
35
40
45
50
55
60
65
70
Extent of Conversion

PROCESS FOR PRODUCING A HIGH QUALITY LUBRICATING OIL USING A VI SELECTIVE CATALYST

BACKGROUND OF THE INVENTION

FIELD OF THE INVENTION

The present invention relates to a process for hydrocracking a hydrocarbonaceous feed to make a lubricating oil base stock. In particular, the process of this invention relates to a catalytic hydrocracking process wherein the catalyst system exhibits surprising stability and high viscosity index (VI) selectivity.

The catalyst of the present invention comprises a catalyst having a small amount of zeolite in an amorphous inorganic oxide matrix and containing a hydrogenation component. The catalyst is further characterized as having a significant amount of large pores. In the present process, a hydrocarbonaceous feed is upgraded by reaction over the catalyst system, so that sulfur, nitrogen and aromatic components are removed, and the viscosity index of the lubricating oil base stock is increased relative to that of the feed. The catalyst system also exhibits a high VI selectivity. VI selectivity is a relative measure of the increase in viscosity index during upgrading of a hydrocarbonaceous feed. A high VI selectivity is indicative of a large increase in viscosity index for a given degree of conversion of the feed. The reactions involved in upgrading the hydrocarbonaceous feed according to the present process are generally termed hydrocracking.

Because feeds used in producing lubricating oil base stocks boil up to 1000° F. and above, and contain relatively high nitrogen and sulfur levels, conventional hydrocracking catalysts typically foul quickly. In order to compensate for this high fouling rate, zeolites may be added to the catalysts to increase both activity and stability. However, conventional zeolite-containing hydrocracking catalysts used for upgrading feeds in the preparation of lubes typically have low VI selectivity.

The present invention is based on the discovery of a catalyst containing zeolite and having a pore structure not generally found in lube hydrocracking catalysts which provides both improved stability and improved VI selectivity for the catalyst system.

The pore size distribution of catalysts for hydrotreating heavy oil feedstocks containing metals, particularly residuum feedstocks, have been disclosed in U.S. Pat. Nos. 4,066,574; 4,113,661; and 4,341,625, hereinafter referred to as Tamm '574, Tamm '661, and Tamm '625, and in U.S. Pat. Nos. 5,177,047 and 5,215,955, hereinafter referred to as Threlkel '047 and Threlkel '955. Tamm's patents disclose that heavy oil feedstocks containing metals, particularly residuum feedstocks, are hydrodesulfurized using a catalyst prepared by impregnating Group VIB and Group VIII metals or metal compounds into a support comprising alumina wherein the support has at least 70% of its pore volume in pores having a diameter between 80 and 150 Å. Threlkel '047 teaches that hydrocarbon feedstocks containing metals are hydrodesulfurized using a catalyst prepared by impregnating Group VIB and Group VIII metals or metal compounds into a support comprising alumina wherein the support has at least 70% of its pore volume in pores having a diameter between 70 and 130 Å, with less than 5% of the pore volume being in pores having a diameter above 300 Å and less than 2% of the pore volume being in pores having a diameter above 1000 Å. Threlkel '955 teaches that hydrocarbon feedstocks containing metals are hydrodesulfurized using a catalyst prepared by impregnating Group VIB and Group VIII metals or metal compounds into a support comprising alumina wherein the support has at least 70% of its pore volume in pores having a diameter between 110 and 190 Å, with less than 5% of the pore volume being in pores having a diameter above 500 Å and less than 2% of the pore volume being in pores having a diameter above 1000 Å.

Johnson, in U.S. Pat. No. 5,089,463, discloses a dehydrodemetalation and hydrodesulfurization process using a catalyst comprising a hydrogenation component selected from Group VI and Group VIII metals, and an inorganic oxide refractory support, and wherein the catalyst has 5 to 11 percent of its pore volume in the form of macropores, and a surface area greater than 75 $m^2/g$ of catalyst.

U.S. Pat. No. 4,699,707 discloses that a full-range boiling shale or fraction thereof is hydrotreated using a catalyst having a surface area in the range of 150 to 175 $m^2/g$ and a mean pore diameter between 75 and 85 angstroms and a pore size distribution such that at least 75 percent of the pores are in the range of 60 to 100 angstroms.

U.S. Pat. No. 4,695,365 discloses that a spindle oil is hydrotreated using a catalyst having a surface area of at least 100 $m^2/gm$ and a mean pore diameter between about 75 and 90 angstroms and a pore size distribution wherein at least 70 percent of the pore volume is in pores of diameter in the range from about 20 angstroms below to 20 angstroms above the mean pore diameter.

U.S. Pat. No. 5,171,422 discloses a lube hydrocracking process using a zeolite of the faujasite structure possessing a framework silica:alumina ratio of at least about 50:1.

While these patents generally teach the usefulness of modifying the pore structure of catalysts for treating heavy oils, they do not address the specific problems of achieving high VI selectivity and improved catalyst stability in the hydrocracking of a feed to produce a lubricating oil base stock.

SUMMARY OF THE INVENTION

According to the present invention, a process is provided for producing a lubricating oil base stock which comprises contacting under hydrocracking conditions a hydrocarbonaceous feed with a catalyst comprising a zeolite, a hydrogenation component and an inorganic oxide matrix material, the catalyst having a pore volume in the range of between about 0.25 and about 0.60 $cm^3/g$, with a mean pore diameter between about 40 Å and about 100 Å, with at least about 5% of the pore volume being in pores having a diameter of greater than about 200 Å.

Among other factors, the present invention is based on the discovery that a catalyst containing a small amount of zeolite, and having a pore size distribution characterized by a high density of pores having diameters less than 100 Å, and also high density of pores having diameters greater than about 200 Å, has improved VI selectivity and improved organonitrogen removal activity over conventional hydrocracking catalysts in lube hydrocracking service. Furthermore, the catalyst of this invention has a lower fouling rate than that of conventional catalysts.

BRIEF DESCRIPTION OF THE FIGURES

FIG. 1 is a VI selectivity plot of catalysts of this invention compared with catalysts having pore size distributions outside the range of the catalyst of this invention.

DETAILED DESCRIPTION OF THE INVENTION

Those familiar with the art related to the present invention will appreciate the full scope of the catalyst system and the process summarized above and be able to practice the present invention over its full scope from a detailed description of the principal features of the catalyst system and process which follows.

The discovery of the present process is embodied in a process for producing lubricating oil base stocks comprising hydrocracking a hydrocarbonaceous feed using a catalyst having a low amount of a zeolite component and a pore structure with a high density of pores having a diameter in the region of 40 Å to 100 Å and also having a high density of pores having a diameter above about 200 Å.

The hydrocarbonaceous feeds from which lube oils are made usually contain aromatic components as well as normal and branched paraffins of very long chain lengths. These feeds usually boil in the gas oil range. Preferred feedstocks are vacuum gas oils with normal boiling ranges in the range of 350° C. to 590° C., and deasphalted residual oils having normal boiling ranges from about 480° C. to 650° C. Reduced topped crude oils, shale oils, liquified coal, coke distillates, flask or thermally cracked oils, atmospheric residua, and other heavy oils can also be used. In general, preferred feedstocks are hydrocarbonaceous mixtures boiling above 200° C. and are in the range of about 225° C. to 650° C.

In commercial operations, hydrocracking can take place as a single step process, or as a multi-step process using initial denitrification or desulfurization steps. The hydrocracking step of the invention may be conducted by contacting the feed with a fixed stationary bed of catalyst, with a fixed fluidized bed, or with a transport bed. A simple and therefore preferred configuration is a trickle-bed operation in which the feed is allowed to trickle through a stationary fixed bed, preferably in the presence of hydrogen. Where the hydrocarbonaceous feedstock has a high nitrogen or sulfur content, it is preferable to have a pretreatment stage to remove some portion of the nitrogen or sulfur. With the pretreatment, the hydrocracking catalyst is able to operate more efficiently with a longer operating period than on high nitrogen or sulfur feeds. Normal hydrocracking processes will then substantially eliminate any residual sulfur or nitrogen. Generally, a hydrocarbon feedstock used in hydrocracking should also have a low metals content, e.g., less than about 200 ppm, in order to avoid obstruction of the catalyst and plugging of the catalyst bed.

Although the catalyst used in this method exhibits excellent stability, activity and VI selectivity, reaction conditions must nevertheless be carefully selected to provide the desired conversion rate while minimizing conversion to less desired lower-boiling products. The conditions required to meet these objectives will depend on catalyst activity and selectivity and feedstock characteristics such as boiling range, as well as organonitrogen and aromatic content and structure. While reaction conditions depend on the most judicious compromise of overall activity, i.e., conversion and selectivity, it is one feature of the present invention that selectivity remains high, even at high conversion, and that conversion to less desired lower-boiling products is minimized in the production of the lubricating oil base stock.

Selectivity as it relates to hydrocracking to make a lubricating oil base stock refers to the magnitude of the increase in the viscosity index (VI) of the hydrocarbonaceous feed as a result of hydrocracking. At a given extent of conversion of the feed, a high selectivity refers to a large increase in viscosity index during hydrocracking. Progressively lower selectivities indicate smaller increases in viscosity index, at a constant extent of conversion. The high VI selectivity of the catalyst used in this process results in a high lube yield during hydrocracking.

Typically, hydrocracking conditions include a temperature in the range of 400° F. to 950° F., a pressure in the range of 500 to 3500 psig, a liquid hourly space velocity in the range 0.1 to 20.0, and a total hydrogen supply in the range of 200 to 20,000 SCF of hydrogen per barrel of hydrocarbonaceous feed. Employing the foregoing hydrocracking conditions, conversion of feedstock to hydrocrackate product can be made to come within the range of from about 10 to about 80 weight percent. However, higher conversion rates generally result in lower selectivity and greater amount of light, rather than middle distillate or lube boiling range, products. Thus, a compromise must be drawn between conversion and selectivity, and conversions in the region of about 10 to about 70 percent are preferred. The balancing of reaction conditions to achieve the desired objectives is part of the ordinary skill of the art. As used herein, conversion is that fraction of feed boiling above a target temperature which is converted to products boiling below that temperature. Generally, the target temperature is taken as roughly the minimum of the boiling range of the feed.

The catalyst used in the present invention has a pore structure which enhances the performance of the catalyst for hydrocracking to produce a lubricating oil base stock, including a pore volume in the range of between about 0.25 and about 0.60 $cm^3/g$, preferably between about 0.25 and about 0.45 $cm^3/g$, with a mean pore diameter between about 40 Å and about 100 Å, preferably between about 40 Å and about 80 Å, and with at least about 5 percent, preferably at least about 10 percent and more preferably at least about 15 percent of the pore volume being in pores having a diameter of greater than about 200 Å, preferably greater than about 350 Å. In a separate preferred embodiment, the catalyst has a pore volume with at least about 1 percent of the pore volume being in pores having a diameter of greater than 1000 Å. As used herein, "mean pore diameter" refers to the point on a plot of cumulative pore volume versus pore diameter that corresponds to 50% of the total pore volume of the catalyst as measured by mercury porosimetry or nitrogen physisorption porosimetry.

The catalyst used in the hydrocracking process comprises a large pore aluminosilicate zeolite. Such zeolites are well known in the art, and include, for example, zeolites such as X, Y, ultrastable Y, dealuminated Y, faujasite, ZSM-12, ZSM-18, L, mordenite, beta, offretite, SSZ-24, SSZ-25, SSZ-26, SSZ-31, SSZ-33, SSZ-35 and SSZ-37, SAPO-5, SAPO-31, SAPO-36, SAPO-40, SAPO-41 and VPI-5. Large pore zeolites are generally identified as those zeolites having 12-ring pore openings. W. M. Meier and D. H. Olson, "ATLAS OF ZEOLITE STRUCTURE TYPES" 3rd Edition, Butterworth-Heinemann, 1992, identify and list examples of suitable zeolites.

One of the zeolites which is considered to be a good starting material for the manufacture of hydrocracking catalysts is the well-known synthetic zeolite Y as described in U.S. Pat. 3,130,007 issued Apr. 21, 1964. A number of modifications to this material have been reported, one of which is ultrastable Y zeolite as described in U.S. Pat. No. 3,536,605 issued Oct. 27, 1970. To further enhance the utility of synthetic Y zeolite additional components can be added. For example, U.S. Pat. 3,835,027 issued on Sep. 10, 1974 to Ward et al. describes a hydrocracking catalysts containing at least one amorphous refractory oxide, a crystalline zeolitic aluminosilicate and a hydrogenation component selected from the Group VI and Group VIII metals and their sulfides and their oxides. Kirker, et al., in U.S. Pat. No. 5,171,422, disclose a dealuminated Y zeolite for lube hydrocracking.

The preferred zeolite in the process of the present invention is one having a faujasite structure, such as zeolite y, ultrastable zeolite Y and dealuminated zeolite Y. In order to optimize the generally conflicting objectives of low catalyst fouling rate and high VI selectivity of the catalyst, the catalyst generally contains less than about 20%, preferably less than about 10%, and more preferably less than about 8%, and still more preferably in the range of about 2 to about 6% zeolite on a volatiles-free basis. While within the broadest embodiment a wide variety of zeolites are suitable for the hydrocracking process, the preferred zeolite has low to moderate overall acidity, typically with a $SiO_2/Al_2O_3$ molar ratio in the range of about 5 to about 100, more preferably in the range of about 10 to about 60. Though it is believed that lube yield is not significantly affected by the use of a low $SiO_2/Al_2O_3$ ratio zeolite, low valued, low boiling products tend to be produced during hydrocracking at high conversions with a low $SiO_2/Al_2O_3$ ratio zeolite. Using a zeolite having a higher $SiO_2/Al_2O_3$ ratio tends to product a non-lube fraction having a higher boiling point.

The hydrogenation component may be at least one noble metal and/or at least one non-noble metal. Suitable noble metals include platinum, palladium and other members of the platinum group such as iridium and ruthenium. Suitable non-noble metals include those of Groups VA, VIA, and VIIIA of the Periodic Table. Preferred non-noble metals are chromium, molybdenum, tungsten, cobalt and nickel and combinations of these metals such as nickel-tungsten. Non-noble metal components can be pre-sulfided prior to use by exposure to a sulfur-containing gas such as hydrogen sulfide at elevated temperature to convert the oxide form of the metal to the corresponding sulfide form.

The hydrogenation component can be incorporated into the catalyst by any suitable method such as by commingling during a mixing step, by impregnation or by exchange. The metal can be incorporated in the form of a cationic, anionic or neutral complex; $Pt(NH_3)_4^{2+}$ and cationic complexes of this type will be found convenient for exchanging metals onto the zeolite. Anionic complexes such as heptamolybdate or metatungstate ions are also useful for impregnating metals into the catalysts. One or more active sources of the hydrogenation component may also be blended with the zeolite and active source of the silica-aluminum matrix material during preparation of the catalyst. Active sources of the hydrogenation component include, for example, any material having a form which is not detrimental to the catalyst and which will produce the desired hydrogenating component during preparation, including any drying, calcining and reducing steps of the catalyst. Typical salts which may be used as sources of the hydrogenation component include the nitrates, acetates, sulfates, chlorides.

The amount of hydrogenation component can range from about 0.01 to about 45 percent by weight and is normally from about 0.1 to about 35 percent by weight. The precise amount will, of course, vary; with the nature of the component, less of the highly active noble metals, particularly platinum, being required than of the less active base metals. In this application, the term "noble metal" includes one or more of ruthenium, rhodium, palladium, osmium, iridium or platinum. The term "base metal" includes one or more of Groups VB, VIB and VIII metals, including, for example, vanadium, chromium, molybdenum, tungsten, iron, cobalt, and nickel. Usually a combination of base metals are used, such as the Group VIII metals nickel or cobalt in combination with the Group VIB metals tungsten or molybdenum, and the base metal is usually sulfided or presulfided in the catalyst when or before the catalyst is put on stream. A preferred catalyst for the present process contains in the range from about 1 to about 15% by weight, and preferably from about 2 to about 10% by weight of at least one Group VIII base metal, calculated as the metal monoxide, and in the range from about 5 to about 30% by weight, and preferably from about 10 to about 25% by weight of at least one Group VIB metal, calculated as the metal trioxide.

The zeolite can be composited with porous inorganic oxide matrix materials and mixtures of matrix materials such as silica, alumina, silica-alumina, titania, magnesia, silica-magnesia, silica-zirconia, silica-thoria, silica-beryllia, silica-titania, titania-zirconia, as well as ternary compositions such as silica-alumina-thoria, silica-alumina-titania, silica-alumina-magnesia and silica-magnesia-zirconia. The matrix can be in the form of a cogel. A preferred support material to facilitate catalyst preparation and improve catalyst physical properties is an alumina support. Even more preferred is a zeolite composited with a silica alumina matrix material, with at least 1% additional alumina binder. When the zeolite is composited with one or more inorganic oxide matrix material(s) to make the catalyst, the catalyst comprises from about 30 to about 90 weight percent, more preferably from about 45 to about 75 weight percent of the inorganic oxide matrix material. Silica alumina matrix materials useful in the catalyst of this process generally have a silica/alumina mole ratio in the range of between about 10/90 and 90/10, preferably in the range of between about 20/80 and 80/20, and more preferably in the range of between about 25/75 and 75/25. Ground catalyst which contains hydrogenation metals and has nominally the same composition as the catalyst of the hydrocracking process may be used as a source of the inorganic oxide matrix material. It is preferred that the inorganic oxide matrix materials used in preparing the catalyst be finely ground to a particle size of 50 microns or less, more preferably to a particle size of 30 microns or less, and still more preferably to a particle size of 10 microns or less.

The zeolite may also be composited with inactive materials, which suitably serve as diluents to control the amount of conversion in the hydrocracking process so that products can be obtained economically without employing other means for controlling the rate of reaction. Naturally occurring clays which can be composited with the catalyst include the montmorillonite and kaolin families, which families include the sub-bentonites, and the kaolins commonly known as Dixie, McNamee, Georgia and Florida clays or others in which the main mineral constituent is halloysite, kaolinite, dickite, nacrite or anauxite. Fibrous clays such as halloysite, sepiolite and attapulgite can also be used as supports. Such clays can be used in the raw state as originally mined or initially subjected to calcination, acid treatment or chemical modification. When used in the present process, the catalyst will generally be in the form of tablets, pellets, extrudates, or any other form which is useful in the particular process.

During preparation of the catalyst of the present process, the zeolite, and sources of the inorganic matrix material are combined with sufficient water to give a volatiles content of the mix of between 40 and 60 weight percent, more preferably between 45 and 55 weight percent. This mix is then formed into a desired shape, and the shaped particles thermally treated to form the catalyst. The term "volatiles" as used herein is the material evolved during the high temperature (≧900° F.) drying. The shape of the catalyst depends on the specific application and process conditions of the hydrocracking process including but not limited to tablets, pellets, extrudates, or any other form which is useful in the particular process. The hydrogenation metals may be included by adding active sources of the metals to the mix prior to shaping and heating. Alternatively, the hydrogenation metals may be added after the shading and/or heating steps, using methods known to the art, such as by impregnation.

The overall conversion rate is primarily controlled by reaction temperatures and liquid hourly space velocity, in order to achieve the desired VI of the product. The process can be operated as a single-stage hydroprocessing zone having a catalyst system comprising the hydrocracking catalyst of the present process. It can also be operated as a layered catalyst system having at least two catalyst layers, with the lube hydrocracking catalyst of the present process converting a hydrocarbonaceous feed stream which was previously treated in a first hydroconversion catalyst layer. In a layered catalyst system, the first hydroconversion layer performs some cracking and removes nitrogen and sulfur from the feedstock before contact with the lube hydrocracking catalyst. Preferably, the organonitrogen content of the product leaving the top layer of catalyst is less than 500 ppm, more preferably less than 250 ppm, and still more preferably less than 100 ppm. The top layer of catalyst will generally comprise a hydroconversion catalyst comprising Group VI and/or Group VIII hydrogenation components on a silica or silica-alumina support. Preferred hydrogenation components for the hydrotreating catalyst include nickel, molybdenum, tungsten and cobalt or a combination thereof. An active zeolite, such as a Y-type zeolite, and preferably an active Y-type zeolite having a $SiO_2/Al_2O_3$ of less than about 10, may be included with the hydroconversion catalyst in order to increase activity and catalyst stability. The relative amounts of catalyst used in the various catalyst layers is specific to each reactor system and feedstream used, depending on, for example, the severity of the operating conditions, the boiling range of the feed, the quantity of heteroatoms such as nitrogen and sulfur in the feed, and the desired lubricating oil base stock properties. Typically, in a catalyst system comprising a hydroconversion catalyst layer and a lube hydrocracking catalyst layer, the volumetric ratio Of hydroconversion catalyst to hydrocracking catalyst is in the range between about 1/99 and about 99/1, preferably between about 10/90 and about 50/50.

Hydroconversion reaction conditions in the hydroconversion catalyst layer may be the same as or different from conditions in the hydrocracking layer. Generally, hydroconversion conditions include a temperature in the range of 400° F. to 950° F., a pressure in the range of 500 to 3500 psig, a liquid hourly space velocity in the range 0.1 to 20.0, and a total hydrogen supply in the range of 200 to 20,000 SCF of hydrogen per barrel of hydrocarbonaceous feed.

The lubricating oil base stock produced by the present hydrocracking process will have a high viscosity index, a low nitrogen content and a low sulfur content. Prior to additional processing, it may be distilled into two or more fractions of varying boiling points, with each fraction being characterized by a particular viscosity index value and a particular nitrogen and a particular sulfur content. Generally, at least one of the fractions will have a viscosity index greater than about 85 and preferably greater than about 90. However, the viscosity index can be as high as 125 or even 130, depending on the feedstock being treated. While methods are available for determining the viscosity index of a waxy stock, the viscosity index values given here are based on lubricating oil base stocks which have been solvent dewaxed, using methods well known in the art, to a −10° C. pour point.

The catalyst of the present process also removes a substantial portion of the organonitrogen and organosulfur compounds from the hydrocarbonaceous feed. These reactions removing heteroatom compounds are important, as organonitrogen, and to a lesser extent organosulfur compounds, are detrimental to downstream processing of the lubricating oil base stock, such as dewaxing and hydrofinishing. Products of the heteroatom removal reactions, such as ammonia and hydrogen sulfide, are significantly less detrimental to these downstream processes. The nitrogen and sulfur contents of the lubricating oil base stocks, or at least one of the distillate fractions derived from the lubricating oil base stock, will typically be less than 25 ppm, usually less than 10 ppm, and levels as low as 1 ppm or less are often observed. Indeed, it is an important characteristic of the catalyst of this process that nitrogen compounds are converted to ammonia at much higher reaction rates, and to much larger extent, than catalysts used in conventional lube hydrocracking processes.

The lubricating oil base stock produced by the hydrocracking step may be dewaxed following hydrocracking. Dewaxing may be accomplished by one or more processes known to the art, including solvent dewaxing or catalytic dewaxing. Zeolites such as ZSM-5, ZSM-11, ZSM-12, ZSM-23, ZSM-35 and ZSM-38 have been proposed for this purpose in dewaxing processes and their use is described in U.S. Pat. Nos. 3,700,585; 3,894,938; 4,176,050; 4,181,598; 4,222,855; 4,229,282 and 4,247,388. Zeolite SSZ-32 and dewaxing processes using SSZ-32 are described in U.S. Pat. Nos. 5,053,373 and 5,252,527, the disclosures of which are incorporated herein by reference. SAPO-11 and dewaxing processes using SAPO-11 are described in U.S. Pat. No. 4,859,311, the disclosure of which is incorporated herein by reference.

Dewaxing is typically conducted at temperatures ranging from about 200° C. to about 475° C. at pressures from about 15 psig to about 3000 psig at space velocities (LHSV) between about 0.1 and 20 and at hydrogen recycle rates of 500 to 30,000 SCF/bbl. The dewaxing catalyst may include a hydrogenation component, particularly the Group VIII metals such as cobalt, nickel, palladium and platinum.

It is often desirable to use mild hydrogenation (sometimes referred to as hydrofinishing) to produce more stable lubricating oils. The hydrofinishing step can be performed either before or after the dewaxing step, and preferably after. Hydrofinishing is typically conducted at temperatures ranging from about 190° C. to about 340° C. at pressures from about 400 psig to about 3000 psig at space velocities (LHSV) between about 0.1 and 20 and at hydrogen recycle rates of 400 to 1500 SCF/bbl. The hydrogenation catalyst employed must be active enough not only to hydrogenate the olefins, diolefins and color bodies within the lube oil fractions, but also to reduce the aromatic content. The hydrofinishing step is beneficial in preparing an acceptably stable lubricating oil since lubricant oils prepared from hydrocracked stocks tend to be unstable to air and light and tend to form sludges spontaneously and quickly.

Suitable hydrogenation catalysts include conventional metallic hydrogenation catalysts, particularly the Group VIII metals such as cobalt, nickel, palladium and platinum.

The metal is typically associated with carriers such as bauxite alumina, silica gel, silica-alumina composites, and crystalline aluminosilicate zeolites. Palladium is a particularly preferred hydrogenation metal. If desired, non-noble Group VIII metals can be used. Metal oxides or sulfides can be used. Suitable catalysts are detailed, for instance, in U.S. Pat. Nos. 3,852,207; 4,157,294; 3,904,513 and 4,673,487, all of which are incorporated herein by reference.

These and other specific applications of the catalyst and process of the present invention are illustrated in the following examples.

EXAMPLES

Example 1

A nickel/nitric acid solution was prepared by dissolving 142.4 grams of $Ni(NO_3)_2.6H_2O$ in 120 cc of deionized water and carefully mixing with 10.3 g of 70% nitric acid.

204.13 g ammonium metatungstate was dissolved in 220 cc of deionized water. The pH of the solution was 2.70.

107.8 (volatiles free) g Plural alumina, 28.8 g (volatiles free) of PG/Conteka CBV-760 ultrastable Y zeolite with a silica/alumina mole ratio of 62, and 363.4 g (volatiles free) Siral 40 (Condea: 40/60 $SiO_2/Al_2O_3$) powder was combined an a small BP mixer and mixed for five minutes. The jacket temperature of the mixer was maintained at 140°–160° F. while 133 cc of deionized water was slowly added. After 3 minutes mixing, the nickel/nitric acid solution was added by spraying into the material in the mixer. After three minutes the ammonium metatungstate solution was added, and the mixing continued for an additional 7 minutes. This mixture was then found to have a pH of 4.07 and a volatiles content of 49.8%.

The mixture was then extruded, and the extrudates placed 1 inch deep in a screen tray and dried at 320° F. for one hour. The dried extrudate were then heated to 950° F. over a 1.5 hour period and held at 950° F. for one hour in 2 scf/hour of flowing dry air.

Example 2

A nickel/nitric acid solution was prepared by dissolving 156.9 grams of $Ni(NO_3)_2.6H_2O$ in 120 cc of deionized water and carefully mixing with 10.3 g of 70% nitric acid.

178.8 g ammonium metatungstate was dissolved in 220 cc of deionized water. The pH of the solution was 2.77.

105 g (volatiles-free) Catapal B alumina (Engelhard), 35.0 g (volatiles-free) of CBV-500 ultrastable Y zeolite (PQ/Conteka) ground to a nominal particle size of 2 microns and having a silica/alumina mole ratio of 5.7, and 290.0 g (volatiles-free) Siral 40 (Condea: 40/60 $SiO_2/Al_2O_3$) powder was combined an a small BP mixer and mixed for five minutes. The jacket temperature of the mixer was maintained at 140°–160° F. while 125 cc of deionized water was slowly added. After 3 minutes mixing, the nickel/nitric acid solution was added by spraying into the material in the mixer. After five minutes of additional mixing, the ammonium metatungstate solution was added, and the mixing continued for an additional 5 minutes. 70.0 g (volatiles-free) of a commercial nickel/tungsten/silica/alumina hydrotreating catalyst, having approximately the same elemental composition as the catalyst being prepared in this example, and ground to a nominal particle size of less than 10 microns was then slowly added, and the mixture mixed an additional 9 minutes. The mixture was then found to have a pH of 4.35 and a volatiles content of 50.1%.

The mixture was then extruded, and the extrudates placed 1 inch deep in a screen tray and dried at 320° F. for one hour. The dried extrudate were then heated to 950° F. over a 1.5 hour period and held at 950° F. for one hour in 2 scf/hour of flowing dry air.

Properties of the catalysts are listed in the following table:

| | Ex. 1 | Ex. 2 |
|---|---|---|
| Catalyst Composition | | |
| Aluminum | 23.7 wt % | 23.3 wt % |
| Nickel | 3.84 wt % | 5.36 wt % |
| Silicon | 10.9 wt % | 10.5 wt % |
| Tungsten | 19.7 wt % | 20.3 wt % |
| Pore volume by mercury porosimetry (ASTM D4284) | | |
| Total: | 0.3158 $cm^3/g$ | 0.395 $cm^3/g$ |
| Macropore: | 0.0394 $cm^3/g$ | 0.0918 $cm^3/g$ |
| Particle Density | 1.44 $g/cm^3$ | 1.33 $g/cm^3$ |

Example 3

Catalyst A

Catalysts of this invention were tested as follows. For each test a pilot plant reactor was charged with a layer of standard zeolite-containing hydroconversion catalyst and a layer of the hydrocracking catalyst of this invention containing 4% zeolite (Catalyst A), in which the volume ratio of hydroconversion catalyst/hydrocracking catalyst was roughly ½.

After presulfiding the catalysts, they were tested with a standard vacuum gas oil feed at 2200 psig total pressure and 0.48 LHSV, with the temperature controlled to achieve a target conversion. Products were fractionated, and the 650° F.+ fraction solvent dewaxed and a viscosity index determined. FIG. 1 shows the results from testing a number of catalysts of this invention, with the data showing the viscosity index of the 650° F.+ product as a function of extent of conversion.

Catalyst B

The test was repeated using a layered catalyst system with the standard zeolite-containing hydroconversion catalyst layered with a catalyst having the same pore size distribution as Catalyst A, and with 10% zeolite (Catalyst B). The VI selectivity data from this test, which is also included in FIG. 1, is equal to that of the comparative Catalyst C (described below).

Catalyst C

The test was repeated using a layered catalyst system with the standard zeolite-containing hydroconversion catalyst layered with a commercial non-zeolitic hydrocracking catalyst (Catalyst C). The data taken from this test, which is also included in FIG. 1, shows that the VI selectivity of this catalyst was approximately 5 VI numbers lower than that of Catalyst A.

Catalyst D

The test was repeated using a layered catalyst system with the standard zeolite-containing hydroconversion catalyst layered with a catalyst having a pore size distribution smaller than that Catalyst A, and with 10% zeolite (Catalyst D). The data from this test, which is also included in FIG. 1, shows that the VI selectivity was reduced even further when a catalyst containing a larger amount of zeolite and having a pore size distribution outside the range of the catalyst of this invention was used.

There are numerous variations on the present invention which are possible in light of the teachings and examples supporting the present invention. It is therefore understood that within the scope of the following claims, the invention may be practiced otherwise than as specifically described or exemplified herein.

What is claimed is:

1. A process for producing a lubricating oil base stock which comprises contacting under hydrocracking conditions a hydrocarbonaceous feed, having a normal boiling range in the range of about 225° C. to 650° C., with a catalyst comprising a zeolite, wherein the catalyst contains less than 8% zeolite, a hydrogenation component and from about 30 to about 90 percent by weight of a silica alumina matrix material having a silica/alumina mole ratio in the range of between about 10/90 and 90/10, the catalyst having a pore volume in the range of between about 0.25 and about 0.60 $cm^3/g$, with a mean pore diameter between about 40 Å, and about 100 Å, with at least about 5% of the pore volume being in pores having a diameter of greater than about 200 Å, wherein the hydrocracking conditions are sufficient to produce a lubricating oil base stock having a viscosity index higher than that of the feed.

2. The process according to claim 1 wherein the mean pore diameter is between about 40 and about 80 Å.

3. The process according to claim 1 wherein at least about 10% of the pore volume is in pores having a diameter greater than about 200 Å.

4. The process according to claim 1 wherein at least about 15% of the pore volume is in pores having a diameter greater than about 200 Å.

5. The process according to claim 4 wherein at least about 1% of the pore volume is in pores having a diameter greater than about 1000 Å.

6.The process according to claim 1 wherein the zeolite is selected from zeolite Y, dealuminated zeolite Y and ultrastable zeolite Y.

7. The process according to claim 1 wherein the zeolite has a $SiO_2/Al_2O_3$ molar ratio in the range of between about 5 and about 100.

8. The process according to claim 1 wherein the zeolite has a $SiO_2/Al_2O_3$ molar ratio in the range of between about 5 and about 60.

9. The process according to claim 1 wherein the catalyst contains from about 0.01 to about 45 percent by weight of the hydrogenation component.

10. The process according to claim 9 wherein the hydrogenation component comprises from about 5% to about 30% by weight, calculated as the metal trioxide, of at least one Group VIB metal selected from tungsten, molybdenum and combinations thereof.

11. The process according to claim 10 wherein the hydrogenation component comprises from about 1% to about 15% by weight, calculated as the metal monoxide, of at least one Group VIII base metal selected from nickel, cobalt and combinations thereof.

12. The process according to claim 1 wherein the hydrocarbonaceous feed is a vacuum gas oil having a normal boiling range in the range of about 350° C. to 590° C.

13. The process according to claim 1 wherein the hydrocarbonaceous feed is a deasphalted residual oil having a normal boiling range in the range of about 480° C. to 650° C.

14. The process according to claim 1 wherein the hydrocracking conditions include a temperature in the range of 400° F. to 950° F., a pressure in the range of 500 to 3500 psig, a liquid hourly space velocity in the range 0.1 to 20.0, and a total hydrogen supply in the range of 200 to 20,000 SCF of hydrogen per barrel of hydrocarbonaceous feed.

15. The process according to claim 1 providing a conversion of from about 10 to about 80 weight percent of the hydrocarbonaceous feed to a hydrocrackate product having a normal boiling range below the normal boiling range of the feed.

16. A process according to claim 1 wherein a 650° F.+ fraction of the lubricating oil base stock is subjected to dewaxing, hydrofinishing, or a combination thereof.

17. The process according to claim 16 wherein the dewaxing is carried out under catalytic dewaxing or solvent dewaxing conditions.

18. A process for producing a lubricating oil base stock which comprises contacting under hydrocracking conditions a hydrocarbonaceous feed with a catalyst comprising:

a. a zeolite having a faujasite structure, wherein the catalyst contains less than 8% zeolite;

b. from about 1 to about 15% by weight, calculated as the metal monoxide, of at least one Group VIII metal selected from nickel, cobalt and combinations thereof, and from about 5 to about 30% by weight, calculated as the metal trioxide, of at least one Group VIB metal selected from tungsten, molybdenum and combinations thereof; and c. from about 45 to about 75% by weight of an amorphous silica-alumina matrix material; and d. sufficient alumina support material to make 100% by weight; wherein the catalyst has a pore volume in the range of between about 0.25 and about 0.45 $cm^3/g$, with a mean pore diameter between about 40 Å, and about 100 Å, and with at least about 5% of the pore volume being in pores having a diameter of greater than about 200 Å, and wherein the hydrocarbonaceous feed is a vacuum gas oil having a normal boiling range in the range of about 350° C. to 590° C., and wherein the hydrocracking conditions are sufficient to produce a lubricating oil base stock having a viscosity index higher than that of the feed.

19. A process for producing a lubricating oil base stock comprising: contacting a hydrocarbonaceous feed, having a normal boiling range in the range of about 225° C. to 650° C., in a first catalytic layer under hydroconversion conditions with a hydroconversion catalyst to produce a denitrified product having a nitrogen content of less than 100 ppm; and b. contacting the denitrified product in a second catalytic layer under hydrocracking conditions with a catalyst comprising a zeolite having a faujasite structure, wherein the catalyst contains less than 8% zeolite, a hydrogenation component, and a silica-alumina matrix material having a silica/alumina mole ratio in the range of between about 10/90 and 90/10, the catalyst having a pore volume in the range of between about 0.25 and about 0.60 $cm^3/g$, with a mean pore diameter between about 40 Å and about 100 Å, with at least about 5% of the pore volume being in pores having a diameter of greater than about 200 Å, wherein the hydrocracking conditions are sufficient to produce a lubricating oil base stock having a viscosity index higher than that of the feed.

* * * * *